United States Patent [19]

Shindou et al.

[11] Patent Number: 4,985,311

[45] Date of Patent: Jan. 15, 1991

[54] ZN-NI BASED COMPOSITE ELECTROPLATED STEEL SHEET AND MULTI-LAYER COMPOSITE PLATED STEEL SHEET

[75] Inventors: Yoshio Shindou; Fumio Yamazaki, both of Kimitsu, Japan

[73] Assignee: Nippon Steel Corporation, Japan

[21] Appl. No.: 404,986

[22] Filed: Sep. 11, 1989

Related U.S. Application Data

[63] Continuation-in-part of Ser. No. 272,846, Nov. 18, 1988, abandoned.

[51] Int. Cl.[5] ..... B21D 39/00

[52] U.S. Cl. ..... 428/623; 423/121

[58] Field of Search ..... 428/623; 423/121

[56] References Cited

U.S. PATENT DOCUMENTS 4,495,008 1/1985 Bruno ..... 428/623

4,617,179 10/1986 Veyrier ..... 423/121

OTHER PUBLICATIONS

Derwent Abstract No. 87-099046/14.

Derwent Abstract No. 87-105923/15.

Derwent Abstract No. 85-220516/36.

*Primary Examiner*—Peter D. Rosenberg

*Attorney, Agent, or Firm*—Pollock, Vande Sande & Priddy

[57] ABSTRACT

Disclosed is a Zn-Ni based composite plated steel sheet excellent in corrosion resistance and workability which comprises a ferrous substrate and, provided thereon, a Zn-Ni based composite electroplating layer comprising 1-15% by weight of Ni, 0.1-10% by weight of Cr, 0.1-10% by weight of $SiO_2$, 0.01-3% by weight of Fe and the balance being essentially Zn. This steel sheet may further have a Zn or Zn based alloy electroplating upper layer to further improve corrosion resistance after coating. Furthermore, in order to remarkably improve corrosion resistance, the steel sheet may further have a hardly soluble chromate film layer of 10-150 $mg/m^2$ in total Cr content and an epoxy resin thin film layer containing agglomerated $SiO_2$ provided on said chromate film layer.

15 Claims, No Drawings

ZN-NI BASED COMPOSITE ELECTROPLATED STEEL SHEET AND MULTI-LAYER COMPOSITE PLATED STEEL SHEET

This is a continuation-in-part of pending U.S. patent application Ser. No. 07/272,846 filed Nov. 18, 1988 and entitled "Zn—Ni BASED COMPOSITE ELECTROPLATED STEEL SHEET", disclosure of which is incorporated herein be reference.

BACKGROUND OF THE INVENTION

The present invention relates to a Zn—Ni based composite electroplated steel sheet excellent in various properties such as corrosion resistance and processability The present invention further relates to a multi-layer composite plated steel sheet which comprises said Zn—Ni based composite electroplated steel sheet as a substrate and, provided thereon, a composite film layer mainly composed of $SiO_2$. More particularly, the present invention relates to a high-corrosion resistant multi-layer composite plated steel sheet which has excellent corrosion resistance, press workability and spot weldability and which is suitable, for example, for rust proofed steel sheet for the automobiles, especially for inner side of bodies.

BACKGROUND ART

As is well known, zinc electroplated steel sheets have been widely used as surface treated steel sheets which are improved in corrosion resistance of cold-rolled steel sheet and corrosion resistance after coating and can be mass-produced without damaging workability.

Recently, it has been attempted to use zinc plated steel sheet as rust proofed steel sheet of automobiles against salts scattered on roads for prevention of freezing in the winter season and thus demand for corrosion resistance in severe corroding atmosphere increases.

Increasing the amount of zinc to be plated (deposition amount) has been known for improving corrosion resistance. As other methods, there have been proposed many methods of plating alloys to control dissolution of zinc per se. Many of them use alloys containing iron family elements such as Fe, Ni and Co and especially, Zn—Ni, Ni—Co and Zn—Fe alloy platings are recognized to be useful and practically used.

Further, various proposals have been made on composite plating according to which materials other than metals are coprecipitated. For example there are disclosed, Zn—$SiO_2$ composite plating in Japanese Patent Kokai No. 54-146228, composite plating of Zn-iron family element alloy which contains $SiO_2$, $TiO_2$, etc. in Japanese Patent Kokai No. 60-141898 of the present inventors and composite plating which contains alumina in Japanese Patent Kokai Nos. 60-125395 and 61-270398 Corrosion resistance of these composite platings depends mainly on the uniformity of the coprecipitated materials such as alumina and $SiO_2$ in the plated layer. Sometimes, coprecipitated materials are agglomerated to mass depending on plating conditions or composition and amount of precipitation becomes unstable. Thus, the effect as expected is not exhibited. Furthermore, corrosion resistance is still insufficient under severe corrosion environment such as cold district and besides, workability is also inferior.

SUMMARY OF THE INVENTION

Accordingly, an object of the present invention is to provide a Zn—Ni based composite electroplated steel sheet free from the aforementioned defects of the conventional techniques and superior in various properties such as corrosion resistance and workability and a highly corrosion resistant multi-layer composite plated steel sheet which includes said Zn—Ni based composite electroplating layer as an underplating layer.

DESCRIPTION OF THE INVENTION

The present invention has been made based on the following findings.

(1) As the coprecipitation substance, $SiO_2$ is the most effective for improvement of corrosion resistance and only when this is uniformly and finely coprecipitated in the plating layer, the corrosion resistance is sharply improved.

(2) As an accelerator for coprecipitation of $SiO_2$,an iron family element, especially Ni is effective as shown in Japanese Patent Kokai No 60-141898 but it is difficult with only Ni to stably coprecipitate $SiO_2$ in the plating layer For solving this problem, the addition of $Cr^{3+}$is very effective and when Cr ion is allowed to coexist in a plating bath, it is possible to stably and uniformly coprecipitate $SiO_2$ and besides Cr is also inductively coprecipitated together with $SiO_2$, resulting in further improvement of corrosion resistance. This is the first point of the present invention. It is considered that this is because the repulsion force between $SiO_2$ is increased by the adsorption of Ni ion and Cr ion around $SiO_2$ and as a result, agglomeration of $SiO_2$ is suppressed and $SiO_2$ is stably and finely collected in the plating (3) However, the coprecipitation of Zn metal and chromium metal is difficult and besides, when $SiO_2$ to which Ni and Cr are adsorbed is precipitated in Zn metal, workability decreases. In order to solve these problems, the addition of Fe is necessary.

That is, the effect of Fe is to prevent the formation of a plating structure which lacks uniformity and smoothness due to the inhibition of uniform growth of electrodeposited Zn and Ni caused by Cr ion added for precipitation of $SiO_2$. The second point of the present invention resides in finding such effect of Fe.

The reason is not clear, but it can be suppose that when Cr ion adsorbed to $SiO_2$ is electrodeposited, this can have stable structure in Zn—Ni plating layer only through Fe. As a result, Cr and $SiO_2$ are taken into Zn—Ni plating layer without inhibiting the uniform growth of Zn—Ni plating layer, resulting in a structure superior in workability.

(4) Especially, corrosion resistance after coating is improved when Zn or Zn based alloy plating layer is provided on the above-mentioned Zn—Ni plating layer.

(5) When $SiO_2$ is contained in both the Zn—Ni based composite electroplated substrate layer and a ceramics composite film layer cured with an organic resin which is provided on said layer, corrosion resistance is remakably improved.

The present invention has been accomplished by making further studies based on the above-mentioned findings.

That is, the present invention is a Zn—Ni based composite electroplated steel sheet superior in corrosion resistance and workability which comprises a steel sheet and, provided thereon, a Zn—Ni based composite electroplating layer comprising Ni:1–15% by weight, Cr:0.1–10% by weight, $SiO_2$:0.1–10% by weight, Fe:0.-01–3% by weight and the balance being Zn; the above Zn—Ni based composite electroplated steel sheet which is further provided thereon, with a Zn or Zn based alloy electroplating plating layer; a highly corrosion-resistant multi-layer composite plated sheet which comprises said Zn—Ni composite electroplated steel sheet as a substrate and, provided thereon, a hardly soluble chromate film containing 5% or less of water-soluble matter at a coating weight of 10–150 mg/m$^2$ in terms of total chromium content as a second layer and a multi-layer film layer containing $SiO_2$ cured with a solvent type epoxy resin as a third layer at a thickness of 0.3–3 μ; and said highly corrosion-resistant multi-layer composite plated steel sheet wherein the composite film layer of the third layer contains 20–80% by weight, based on the resin, of $SiO_2$ which is a secondary agglomerate formed by previously agglomerating dry $SiO_2$ nm in average particle size to a size of 0.3–3 μ in a solvent type epoxy resin.

The present invention will be explained in more detail below.

The Ni content in the Zn—Ni composite plating layer is specified to be 1–15% by weight. This is because conditions for adsorbing Ni together with Cr to $SiO_2$ in a plating bath and easily uniformly dispersing and co-precipitating $SiO_2$ the plating layer are aimed at and furthermore, the alloying effect of Ni is taken into consideration. When the Ni content is less than 1% by weight, especially corrosion resistance before coating is insufficient and when more than 15% by weight, workability is much deteriorated.

Cr content is 0 1–10% by weight and precipitation of such a large amount of Cr becomes possible in H the presence of Fe and $SiO_2$ together. The amount of Cr determines, precipitation depending on the contents $SiO_2$ and Fe, but when it is less than 0.1% by weight, the effect for enhancing the corrosion resistance is not exhibited and when more than 10% by weight, the effect is saturated and workability is deteriorated.

The $SiO_2$ content is specified to be 0.1–10% by weight. In order to stably and uniformly coprecipitate $SiO_2$ in plating layer, it is necessary to allow $Cr^{3+}$to exist in the plating bath in addition to Ni and Fe. as a buffer for pH of atmosphere and further, prevents diffusion of corrosion products. When the content of $SiO_2$ is less than 0.1% by weight, the effect to enhance the corrosion resistance is not exhibited and when more than 10% by weight, workability and plate adhesion are deteriorated.

The particle size of $SiO_2$ in the plating layer is in the range of 1 to smaller than 100 mμ. If the particle size is not smaller than 100 mμ, the effect of improving the corrosion resistance is insufficiently obtained and workability may be reduced.

The Fe content is specified to be 0.01–3% by weight. The roles of Fe in the composite plated steel sheet are mainly to accelerate bonding of Cr and Zn which is a main component in the plating layer by entering between them and to improve workability. In this sense, if the content is less than 0.01% by weight, the above effects cannot be exhibited and if more than 3% by weight, not only these effects are saturated, but corrosion resistance before coating is deteriorated.

A plating amount of 10–50 g/m$^2$ is enough to ensure corrosion resistance.

This composite electroplated steel sheet may be of a single plating layer as mentioned hereabove or it may be additionally plated thereover with a small amount of Zn or a Zn based alloy such as Zn—Ni or Zn–Fe When the additional Zn or Zn based alloy plating is applied, the amount thereof is preferably 1–5 g/m$^2$ and thus stable and good corrosion resistance after coating is obtained. This is also advantageous for avoiding defects of the coating film at the time of cationic electrodeposition operation.

The effect of the present invention is not substantially influenccd by inevitable coprecipitation of a slight amount of Co, Pb, Sn, Ag, In, Bi, Cu, Sb, As, Al, Ti, Na, P, 0, C or the like besides Zn, Ni Cr, $SiO_2$ and Fe.

With reference to the method of production, the aforementioned composite electroplated steel sheet can be produced by subjecting a steel sheet to an electroplating with an acidic electroplating bath containing 30–60 g/l of $Zn^{2+}$and 5–60 g/l of $Ni^{2+}$ in which 1–30 g/l of $Cr^{3+}$, 5–50 g/l of $SiO_2$ and 0.1–10 g/l of $Fe^{2+}$ are allowed to coexist at a pH of 1–3 and a bath temperature of 40° -70° C. and at a current density of 50–300 A/dm$^2$ In addition, electroconducting aids such as salts of $Na+$, $K+$, $NH_4+$ and pH buffer such as boric acid may also be contained in the plating bath Chromium sulfate is preferred as a source of Cr in case of a sulfuric acid acidic bath As $SiO_2$, there may be used any of aqueous dispersion sol thereof, colloidal silica, dry silica and fumed silica, but desirably is fine particles of 1 to less than 100 mμ in primary particle size.

In the present invention, corrosion resistance can be further improved by providing an $SiO_2$ composite film layer cured with an epoxy resin on said $SiO_2$containing composite plating layer or said Zn or Zn based alloy plating layer through a chromate layer as an intermediate layer therebetween.

The mechanism of preventing corrosion by $SiO_2$ has not yet been fully elucidated However, basic factors therefor are considered that with corrosion of Zn a stable rust of $Zn(OH)_2$-$SiO_2$ is formed on the surface and this acts as a protective film and that $SiO_2$ per se is excellent in alkali resistance. Therefore, for attaining high corrosion resistance, it may be attempted to contain a large amount of $SiO_2$ in the plating layer, but it is very difficult to contain a large amount of $SiO_2$ by electroplating in view of the viscosity of the bath and for control of the bath. Besides, even if $SiO_2$ is contained in a large amount, the powdering property is markedly deteriorated and the product is practically not satisfactory. According to the present invention, $SiO_2$ is contained at a practical level in the substrate composite plating layer and thereon is provided a thin film-like composite film cured with an epoxy resin in which $SiO_2$ is agglomerated in a suitable size, whereby $SiO_2$ is agglomerated in a suitable size, whereby $SiO_2$ can be present in a totally sufficient amount to attain corrosion resistance and thus corrosion resistance can be remarkably enhanced.

Here, spot weldability and press workability may be questioned because $SiO_2$ is an insulant and a solid, but it has been found that these properties are rather improved if the amount of $SiO_2$ is properly controlled. That is, since an $SiO_2$ composite film layer higher in electric resistance than the plating layer is provided as an upper layer and an $SiO_2$ based composite plating layer lower than the upper layer and higher than steel sheet in electric resistance is provided as a lower layer, when spot welding is effected, first the $SiO_2$ composite film layer and then the $SiO_2$ based composite plating layer generate heat and are dissolved in succession and as a result, joining between steel sheets is smoothened. When press working is effected, $SiO_2$ exhibits a kind of lubricating function by proper adjustment of amounts of the resin and $SiO_2$ in the upper composite film layer, whereby peeling of the plating layer and composite film layer and build-up thereof to mold can be reduced The second and third layers of the multi-layer composite plated steel sheet will be explained below The second layer is a hardly soluble chromate film of 5% or less in water-soluble matter content and of a coating weight of 10–150 mg/m$^2$ in terms of total Cr amount.

The chromate film used in the present invention which is provided between the lower plating layer and the upper coating film improves adhesion of the coating film and thus this is a very important film for imparting high corrosion resistance to the organic composite plated steel sheet. Especially, the steel sheet must have water-swelling and dissolution resistance and for this purpose, the chromate film must be made hardly soluble When the content of water-soluble matter in chromate film exceeds 5%, much chromium dissolves out due to swelling of chromate film and as a result, adhesion of the upper coating film decreases or it is difficult to further improve corrosion resistance and besides the operation becomes complicated because of the pollution of chemical treating solutions with the dissolving-out chromium and disposal of waste liquid. The content of water-soluble matter in the chromate film is preferably 2% or less.

When the coating weight of the hardly soluble chromate film is less than 10 mg/m$^2$ in terms of total chromium amount, adhesion to the upper coating film is somewhat insufficient or it is difficult to further increase corrosion resistance and life. When the total chromium amount exceeds 150 mg/m$^2$ adhesion to the upper coating film is markedly deteriorated owing to cohesive failure of the chromate film caused by press working and the like and furthermore, a bad effect is exerted on the continuous spotting property at spot weldability. The preferred coating weight is 20–100 mg/m$^2$ in terms of total chromium amount Cathodic electrolysis methods are most suitable for formation of the hardly soluble chromate film.

The third layer is a $SiO_2$ composite film formed by coating $SiO_2$ secondarily agglomerated to a particle size of 0 3–3 $\mu$from $SiO_2$ having a primary particle size of 2–20 nm together with an epoxy resin at a thickness of 0.3–3 $\mu$. The epoxy resin acts as a binder resin and is superior to other resins in workability and weldability. As the epoxy resin, there may be used, for example, an epoxy resin containing at least 50% by weight of phenol in molecule as nonvolatile matter of coating, an epoxy ester resin obtained by reacting said epoxy resin with a dicarboxylic acid in the presence or absence of an amine catalyst, an urethanatcd epoxy ester resin obtained by reacting said epoxy ester resin with a partially blocked isocyanate compound and a bisphenol A type resin. Bisphenol A type epoxy resin is especially effective from the point of corrosion resistance. Number-average molecular weight of the epoxy resin is suitably 300–100,000. When this is less than 300, it is not sufficiently polymerized even by reaction, resulting in insufficient corrosion resistance of the coating film and when more than 100,000, sufficient crosslinking reaction is not obtained and corrosion resistance of the coating film is unsatisfactory.

The $SiO_2$ composite film cured with epoxy resin acts synergistically with $SiO_2$ in the substrate plating layer to remarkably enhance corrosion resistance. The $SiO_2$ used here is preferably such that may be dispersed in organic solvents and form secondary agglomeration particles of 0 3–3 $\mu$ and especially preferred is dry $SiO_2$ of 2–20 nm in average particle size.

If the secondary agglomeration particle size is less than 0 3 $\mu$, the effect to improve corrosion resistance is not sufficient and if more than 3 $\mu$, press workability and spot weldability of the steel sheet are deteriorated. To prepare secondary agglomeration particles of 0.3–3 $\mu$, $SiO_2$ of 2–20 nm in average primary particle size may be most suitably used.

In order to prepare secondary agglomerate particles of $SiO_2$, a resin of low solvent content is put in a container containing $SiO_2$ and rough kneading is sufficiently carried out by a high-speed disperser In this case, the adsorption reaction between $SiO_2$ and the resin is allowed to proceed at a temperature lower by at least 10° C. than the glass transition temperature of the resin and they are left to stand until the desired secondary particle size is obtained. Then, kneading is effected again by a three-roll mill, etc. to make even the particle size distribution and then the product is dispersed in a solvent without leaving it. In this case, the point is to carry out stirring at a stretch by a high-speed disperser. When such secondarily agglomerated $SiO_2$ is used, separation of $SiO_2$ does not occur even by dilution with solvent and thin-film high-speed roll coating by a roll coater (150 m/min or higher) becomes possible. As to quality, use of such $SiO_2$ is advantageous in spot weldability and press workability and besides cationic electrodeposition property is improved, resulting in extension of the range of optimum electrodeposition conditions.

The amount of $SiO_2$ is preferably 20°–80° % by weight of resin in the composite film. When the amount is less than 20° by weight, corrosion resistance is insufficient and when more than 80% by weight press workability and spot weldability are deteriorated. The more preferred range is 30–70% by weight. When the thickness of the coating film is less than 0.3 $\mu$, corrosion resistance is insufficient and when more than 3 $\mu$, spot weldability is deteriorated.

The third $SiO_2$ composite film may additionally contain a curing agent for acceleration of curing by baking or a lubricant to further improve press workability.

Useful curing agents are melamine resin, resol type phenolic resin, polyisocyanate compound and blocked polyisocyanate compound. The amount of the curing agent is suitably such as curing agent/epoxy resin=1/10–1/1 in weight ratio of solid content. Curing at low temperature and for short time becomes possible by use of these curing agents and thus use of them is advantageous for production on high-speed continuous coating and baking line. As the lubricants, preferred are those which can be readily separated above in $SiO_2$ composite film such as polyolefins, carboxylic acids, polyesters, metal salts of carboxylic acids, polyalkylene glycols, molybdenum disulfide, silicon compounds and fluorine compounds. Especially effective is polyethylene wax. The wax addition amount of the lubricant is suitably 0 1–10% by weight of $SiO_2$.

The organic solvents in the resin composition used for formation of the $SiO_2$ composite film layer as a third layer are not critical. However, for example, when a bisphenol type epoxy resin is used as epoxy resin and blocked polyisocyanate is used as a curing agent, ketone organic solvents such as, for example, methylisobutyl ketone, acetone, cyclohexanone, isophorone, etc. are especially suitable.

The baking conditions for $SiO_2$ composite film in the present invention are not critical, but short-time baking treatment is possible with keeping good properties in a wide range of 100° -200° C. as the final baking temperature of sheet. The coating method may be any of known methods such as roll coating method, curtain flow coating method and the like. The construction as mentioned hereabove may not necessarily be applied onto both surfaces of a substrate steel sheet and may be applied onto only one surface and another surface may remain as such or may be provided with other plating layer with or without organic film thereon.

When the steel sheet according to the present invention is used as a rustproofed steel sheet for automobiles, it is most preferred that one surface of steel sheet is provided with the Zn—Ni based composite electroplating layer or additionally with the upper plating layer (two plating layers) and this side is used as an outer surface of body and another surface of the sheet is provided with the multi-layer composite electroplating layer having said Zn—Ni based composite electroplating layer as a substrate and this side is used as the internal surface of the body. Such steel sheet can be produced by first applying Zn—Ni composite electroplating layer on both surfaces of a steel sheet and then applying chromate film and $SiO_2$ composite film onto only one surface. If necessary, the surface applied with no chromate film and $SiO_2$ composite film may be applied with Zn or Zn based alloy plating as upper plating layer.

Substrate steel sheet to which the present invention is applied is ordinarily a dull finish rolled mild steel sheet, but the present invention may also be applied to bright finish rolled mild steel sheets, high tensile steel sheets containing Mn, S, P or the like in a large amount as steel components, highly corrosion-resistant steel sheets low in corrosion rate containing Cr, Cu, Ni, P or the like in a large amount, etc.

Examples 1-29 and Comparative Examples 1-12

Cold rolled steel sheets were subjected to degreasing with alkali, pickling with 5% sulfuric acid, washing with water and electroplating under the following conditions. A sulfuric acid bath having a temperature of 60° C. and a pH of 2 and stirred by pump to keep a flow rate of 90 m/min was used. Interval between electrodes was 10 mm. Colloidal silica of 10-20 mμ, 50-100 mμ and 1-2 μ in average particle size and dry silica of 30-50 mμ in average particle size were used as $SiO_2$ added to the plating bath. Contents of Ni, Cr, $SiO_2$ and Fe in plating layer were controlled by controlling the addition amounts thereof and current density and plating amount was 20 g/m$^2$. Zn or Zn based alloy plating was applied onto some of the steel sheets at 3 g/m$^2$ as an upper layer.

The plating conditions are shown in Table 1 and the composition of the plated steel sheets and results of evaluation for corrosion resistance and workability are shown in Table 2.

Notes (1)-(5) in Tables 1 and 2 mean as follows:

(1) Steel sheet:

A: Dull finished steel sheet (low-carbon steel)

B: Bright finished steel sheet (low-carbon steel)

C: High tensile steel (low-carbon steel containing 0.1% P)

D: Low corrosion rate steel sheet (low-carbon steel containing 0.2% Cu, 0.1% Ni and 0 08% P)

E: Low corrosion rate steel sheet (low-carbon steel containing 2% Cr)

Composition of plating bath A sulfate bath; pH 2, bath temperature 60° C. and containing 50 g /1 of $Na_2S_{04}$ as a conducting aid in addition to the components enumerated in Table 1. The upper layer plating was performed in a known plating bath at a current density of 100 A/dm$^2$ for both the Zn and Zn based alloy platings.

$SiO_2$:

A: Colloidal silica of 10-20 mμ in average particle size

C: Dry silica of 50-100 mμ in average particle size

D: Dry silica of 1-2 μ (1000-2000mμ) in average particle size (4) Method of evaluation of corrosion resistance (i) Corrosion resistance before coating The plated samples as such were subjected to the following cyclic corrosion test of 30 cycles. Corrosion resistance was evaluated by decrement of thickness and the results were indicated by the following grade.

| Decrement of thickness | |
|---|---|
| 0-0.1 mm | |
| 0.1-0.2 mm | |
| 0.2-0.3 mm | Δ |
| 0.3 mm ~ | × |

(ii) Corrosion resistance after coating:

The samples were subjected to phosphate treatment by dipping and cationic electrodeposition coating (20 μ) and crosscuts which reached the substrate steel sheet were made on the surface and these samples were subjected to the following cyclic test of 50 cycles. Corrosion resistance was evaluated by width of blistering and the results were indicated by the following grade.

| Width of blistering | |
|---|---|
| 0-1 mm | |
| 1-3 mm | |
| 3-5 mm | Δ |
| 5 mm or more | × |

(iii) Cyclic corrosion test:

(iii) Cyclic corrosion test:

| | |
|---|---|
| Salt spray (JIS Z2371) | 3 hours |
| ↓ | |
| Drying (60° C.) | 2 hours |
| ↓ | |
| Wetting (50° C., RH 95%) | 2 hours |
| ↓ | |
| Cooling (−20° C.) | 1 hour |

Method of evaluation of workability:

The plated samples were press molded into cylinder of 50ϕ×25H and then the cylinder was subjected to adhesive tape peel test. Workability was evaluated by decrement in weight and the result is indicated by the following grade.

| Decrement in weight | |
|---|---|
| 0–2 mg | |
| 2–5 mg | |
| 5–8 mg | Δ |
| 8 mg or more | × |

TABLE 1

| | Plating Conditions | | | | | | | |
|---|---|---|---|---|---|---|---|---|
| | Steel[1] sheet | Composition of plating bath[2] $Zn^{2+}$ | $Ni^{2+}$ | $Cr^{3+}$ | $SiO_2$ | $Fe^{2+}$ | $SiO_2$[3] | Current density ($A/dm^2$) |
| Example 1 | A | 30 | 60 | 1 | 5 | 0.1 | A | 50 |
| Example 2 | A | 40 | 40 | 5 | 10 | 0.1 | A | 100 |
| Example 3 | A | 40 | 40 | 15 | 20 | 0.5 | A | 150 |
| Example 4 | A | 40 | 40 | 20 | 30 | 0.7 | A | 200 |
| Example 5 | A | 60 | 20 | 1 | 5 | 3 | B | 50 |
| Example 6 | A | 50 | 30 | 5 | 10 | 0.1 | B | 100 |
| Example 7 | A | 50 | 30 | 15 | 20 | 0.5 | B | 150 |
| Example 8 | A | 50 | 30 | 20 | 30 | 0.7 | B | 200 |
| Example 9 | B | 60 | 10 | 2 | 5 | 5 | A | 50 |
| Example 10 | C | 40 | 30 | 10 | 15 | 0.1 | A | 100 |
| Example 11 | D | 40 | 30 | 20 | 30 | 0.5 | A | 150 |
| Example 12 | E | 40 | 30 | 30 | 5 | 0.7 | A | 200 |
| Example 13 | A | 60 | 5 | 1 | 15 | 10 | A | 50 |
| Example 14 | A | 50 | 30 | 5 | 30 | 0.1 | A | 100 |
| Example 15 | A | 50 | 30 | 10 | 50 | 0.5 | A | 150 |
| Example 16 | A | 50 | 30 | 20 | 10 | 0.7 | A | 300 |
| Example 17 | A | 30 | 40 | 10 | 15 | 1 | A | 100 |
| Example 18 | A | 40 | 30 | 5 | 20 | 5 | A | 150 |
| Example 19 | A | 30 | 40 | 15 | 20 | 1 | A | 150 |
| Example 20 | A | 40 | 30 | 15 | 15 | 5 | A | 150 |
| Example 21 | A | 30 | 40 | 20 | 5 | 1 | A | 100 |
| Example 22 | A | 40 | 30 | 10 | 30 | 5 | A | 200 |
| Example 23 | B | 30 | 40 | 20 | 30 | 1 | B | 150 |
| Example 24 | C | 40 | 30 | 20 | 30 | 1 | B | 150 |
| Example 25 | D | 40 | 30 | 30 | 30 | 1 | B | 150 |
| Example 26 | E | 40 | 30 | 20 | 50 | 1 | B | 300 |
| Example 27 | A | 40 | 30 | 10 | 30 | 5 | C | 100 |
| Example 28 | B | 30 | 40 | 20 | 30 | 1 | C | 200 |
| Example 29 | C | 40 | 30 | 20 | 30 | 1 | C | 150 |
| Comp. Ex. 1 | A | 30 | 40 | — | — | — | — | 50 |
| Comp. Ex. 2 | A | 30 | 40 | 1 | — | — | — | 100 |
| Comp. Ex. 3 | A | 30 | 40 | — | 20 | — | A | 150 |
| Comp. Ex. 4 | A | 30 | 40 | — | — | 1 | — | 50 |
| Comp. Ex. 5 | A | 30 | 40 | 1 | — | 1 | — | 100 |
| Comp. Ex. 6 | A | 80 | 2 | 5 | 10 | 1 | A | 150 |
| Comp. Ex. 7 | A | 20 | 80 | 5 | 10 | 1 | A | 50 |
| Comp. Ex. 8 | A | 40 | 30 | 0.5 | 2 | 3 | A | 20 |
| Comp. Ex. 9 | A | 40 | 30 | 50 | 100 | 3 | A | 200 |
| Comp. Ex. 10 | A | 40 | 30 | 5 | 10 | — | B | 100 |
| Comp. Ex. 11 | A | 40 | 30 | 5 | 10 | 20 | B | 150 |
| Comp. Ex. 12 | A | 40 | 30 | 20 | 30 | 5 | D | 100 |

TABLE 2

| | Composition of plating layer (wt %) | | | | Upper plating layer | Particle Size of $SiO_2$ in Plating (mμ) | Evaluation of properties | | |
|---|---|---|---|---|---|---|---|---|---|
| | Ni | Cr | $SiO_2$ | Fe | | | Corrosion resistance before coating[4] (i) | Corrosion resistance after coating[4] (ii) | Workability |
| Example 1 | 15 | 0.1 | 0.1 | 0.01 | — | 5 | | | |
| Example 2 | 12 | 1 | 1 | 0.01 | — | 10 | | | |
| Example 3 | 12 | 3 | 3 | 0.03 | — | 20 | | | |
| Example 4 | 12 | 5 | 5 | 0.05 | — | 30 | | | |
| Example 5 | 7 | 0.1 | 0.1 | 1 | — | 30 | | | |
| Example 6 | 9 | 1 | 1 | 0.01 | — | 30 | | | |
| Example 7 | 9 | 3 | 3 | 0.03 | — | 40 | | | |
| Example 8 | 9 | 5 | 5 | 0.05 | — | 50 | | | |
| Example 9 | 5 | 0.2 | 0.1 | 2 | — | 10 | | | |
| Example 10 | 9 | 2 | 1 | 0.01 | — | 10 | | | |
| Example 11 | 9 | 5 | 2 | 0.03 | — | 20 | | | |
| Example 12 | 9 | 10 | 5 | 0.05 | — | 20 | | | |
| Example 13 | 1 | 0.1 | 0.2 | 3 | 20 | — | | | |
| Example 14 | 9 | 1 | 2 | 0.01 | 20 | — | | | |
| Example 15 | 9 | 2 | 5 | 0.03 | 30 | — | | | |
| Example 16 | 9 | 5 | 10 | 0.05 | 50 | — | | | |
| Example 17 | 12 | 2 | 1 | 0.1 | 40 | Zn | | | |
| Example 18 | 9 | 1 | 2 | 2 | 30 | Zn | | | |

TABLE 2-continued

| | Composition of plating layer (wt %) | | | | Upper plating layer | Particle Size of $SiO_2$ in Plating (mμ) | Evaluation of properties: Corrosion resistance before coating[4] (i) | Corrosion resistance after coating[4] (ii) | Workability |
|---|---|---|---|---|---|---|---|---|---|
| | Ni | Cr | $SiO_2$ | Fe | | | | | |
| Example 19 | 12 | 3 | 3 | 0.1 | 20 | Zn-10% Ni | | | |
| Example 20 | 9 | 3 | 3 | 2 | 20 | Zn-10% Ni | | | |
| Example 21 | 12 | 5 | 2 | 0.1 | 30 | Zn-80% Fe | | | |
| Example 22 | 9 | 2 | 5 | 2 | 40 | Zn-80% Fe | | | |
| Example 23 | 12 | 5 | 5 | 0.1 | 50 | Zn | | | |
| Example 24 | 9 | 5 | 5 | 0.1 | 40 | Zn-11% Ni | | | |
| Example 25 | 9 | 10 | 5 | 0.1 | 30 | Zn-11% Ni | | | |
| Example 26 | 9 | 5 | 10 | 0.1 | 50 | Zn-85% Fe | | | |
| Example 27 | 9 | 2 | 5 | 2 | 80 | — | | | |
| Example 28 | 12 | 5 | 5 | 0.1 | 100 | — | | | |
| Example 29 | 9 | 5 | 5 | 0.1 | 60 | — | | | |
| Comp. Ex. 1 | 12 | — | — | — | — | — | X | X | |
| Comp. Ex. 2 | 12 | 0.1 | — | — | — | — | X | Δ | Δ |
| Comp. Ex. 3 | 12 | — | 3 | — | 200 | — | | Δ | Δ |
| Comp. Ex. 4 | 12 | — | — | 0.1 | — | — | X | X | |
| Comp. Ex. 5 | 12 | 0.1 | — | 0.1 | — | — | X | Δ | |
| Comp. Ex. 6 | 0.5 | 1 | 1 | 0.1 | 20 | — | X | Δ | Δ |
| Comp. Ex. 7 | 20 | 1 | 1 | 0.1 | 20 | — | Δ | | X |
| Comp. Ex. 8 | 9 | 0.05 | 0.05 | 1 | 10 | — | Δ | Δ | |
| Comp. Ex. 9 | 9 | 15 | 15 | 1 | 80 | — | | | X |
| Comp. Ex. 10 | 9 | 1 | 1 | — | 40 | — | | | X |
| Comp. Ex. 11 | 9 | 1 | 1 | 5 | 40 | — | X | | |
| Comp. Ex. 12 | 9 | 2 | 5 | 2 | 1000 | — | X | X | X |

Examples 30–48 and Comparative Examples 13–43

The multi-layer composite plated steel sheets were made as follows

The cold rolled steel sheets were subjected to electroplating in the same manner as in the above examples. After washing with water, the plated steel sheets were subjected to cathodic electrolysis in a chromate solution mainly composed of $Cr^{6+}$ to form thereon a chromate film mainly composed of $Cr^{3+}$, followed by washing with and drying. Thereafter, the $SiO_2$ composite film having specific composition was formed on one surface by roll coating at a given thickness and then immediately, the samples were subjected to a baking treatment so that ultimate maximum sheet temperature reached 150° C. in 20 minutes. The plating conditions and properties of the thus obtained multi-layer composite plated steel sheets are shown in Table 3 and Table 4, respectively.

Notes (1)–(3) in Table 3 are the same as in Table 1.

Notes (1)–(7) in Table 4 mean as follows (1) The content of water-soluble matter in chromate film which is expressed by ratio of difference in amount of chromium deposited before and after dipping in boiling distilled water for 30 minutes and initial amount of chromium deposited.

(2) Main resins:

(Kind of main resins)

A: Bisphenol A type epoxy resin (number-average molecular weight 2,900)

B: Urethanated epoxy ester resin (number-average molecular weight 10,000)

C: Oil free polyester resin (number-average molecular weight 15,000)

D: Carboxylated polyethylene resin (number-average molecular weight 100,000)

(Curing agent)

A: Hexamethylene diisocyanate

B: Resol type phenolic resin

C: Hexamethylene diisocyanate

D (20% aqueous solution)

Main resin/curing agent = 10/1–10/10

(3) Indication of particle size of $SiO_2$

| Secondary agglomeration particle size | Average primary particle size: 1 nm | 2 nm | 10 nm | 20 nm | 50 nm |
|---|---|---|---|---|---|
| 0.2μ | SS | MS | RS | NS | LS |
| 0.3–3μ | SM | MM | RM | NM | LM |
| 4μ | SL | ML | RL | NL | LL |

(4) Corrosion resistance:

Corrosion resistance was evaluated by decrement of thickness after subjecting the samples to the following cyclic corrosion test of 200 cycles.

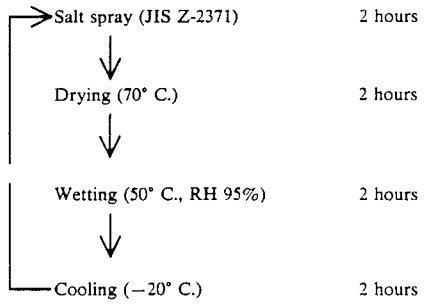

The results are indicated by the following grade.

| Decrement in thickness | |
|---|---|
| Less than 0.1 mm | |
| Not less than 0.1 mm and less than 0.2 mm | |
| Not less than 0.2 mm and less than 0.3 mm | Δ |
| Not less than 0.3 mm | X |

(5) Dissolving-out of chromium:

This was evaluated by total amount of chromium dissolved out into degreasing solution after the samples were subjected to degreasing with alkali (spraying treatment with 20 g/l of degreasing solution L-440 manufactured by Japan Parkerizing Co. at 60° C. for 5 minutes.) and indicated by the following grade.

| | |
|---|---|
| Less than 5 mg/m$^2$ | |
| Not less than 5 mg/m$^2$ and not more than 10 mg/m$^2$ | |
| More than 10 mg/m$^2$ and not more than 30 mg/m$^2$ | Δ |
| More than 30 mg/m$^2$ | X |

(6) Press workability:

The samples were press molded into a cylinder of 50×25H and the worked surface was subjected to adhesion tape peel test Workability was evaluated by decrement in weight and the results are indicated by the following grade.

| Decrement in weight | |
|---|---|
| 0–2 mg | |
| 2–5 mg | |
| More than 5 mg | Δ |
| Breaking of sheet | X |

(7) Spot weldability:

Electrode chip Tip diameter 6 mmϕ, type FC

Applied pressure 200 kg

Current 90% of critical current value of dust formation

Time: 10 cycles

| Number of continuous spot welding | |
|---|---|
| More than 5,000 | |
| More than 4,000 | |
| More than 3,000 | Δ |
| Less than 3,000 | X |

TABLE 3

| | Plating Conditions | | | | | | | |
|---|---|---|---|---|---|---|---|---|
| | Steel[1] sheet | Composition of plating bath[2] (g/l) | | | | | | Current density (A/dm$^2$) |
| | | $Zn^{2+}$ | $Ni^{2+}$ | $Cr^{3+}$ | $SiO_2$ | $Fe^{2+}$ | $SiO_2$[3] | |
| Example 30 | A | 30 | 60 | 1 | 5 | 0.1 | A | 50 |
| Example 31 | A | 60 | 5 | 30 | 10 | 3 | A | 100 |
| Example 32 | A | 60 | 10 | 5 | 20 | 5 | A | 150 |
| Example 33 | A | 30 | 35 | 15 | 30 | 10 | A | 200 |
| Example 34 | A | 60 | 10 | 20 | 50 | 3 | A | 300 |
| Example 35 | A | 40 | 35 | 20 | 20 | 1 | A | 100 |
| Example 36 | A | 40 | 35 | 20 | 20 | 1 | A | 150 |
| Example 37 | A | 40 | 35 | 5 | 20 | 5 | A | 100 |
| Example 38 | A | 40 | 35 | 20 | 20 | 1 | A | 150 |
| Example 39 | A | 40 | 35 | 5 | 20 | 5 | B | 100 |
| Example 40 | A | 40 | 35 | 20 | 20 | 1 | B | 150 |
| Example 41 | A | 40 | 35 | 5 | 20 | 5 | B | 100 |
| Example 42 | A | 40 | 35 | 20 | 20 | 1 | B | 150 |
| Example 43 | A | 40 | 35 | 5 | 20 | 5 | A | 100 |
| Example 44 | A | 40 | 35 | 20 | 20 | 1 | A | 150 |
| Example 45 | B | 40 | 35 | 5 | 20 | 5 | A | 100 |
| Example 46 | C | 40 | 35 | 20 | 20 | 1 | A | 150 |
| Example 47 | D | 40 | 35 | 5 | 20 | 5 | A | 100 |
| Example 48 | E | 40 | 35 | 20 | 20 | 1 | A | 150 |
| Comp. Ex. 13 | A | 40 | 35 | — | — | — | — | 50 |
| Comp. Ex. 14 | A | 40 | 35 | — | — | — | — | 100 |
| Comp. Ex. 15 | A | 40 | 35 | — | 20 | — | A | 150 |
| Comp. Ex. 16 | A | 40 | 35 | 15 | 20 | 1 | A | 200 |
| Comp. Ex. 17 | A | 40 | 35 | 5 | 20 | 5 | A | 100 |
| Comp. Ex. 18 | A | 40 | 35 | — | 2 | — | A | 50 |
| Comp. Ex. 19 | A | 40 | 35 | — | 100 | — | A | 200 |
| Comp. Ex. 20 | A | 70 | 3 | — | 20 | — | A | 100 |
| Comp. Ex. 21 | A | 20 | 80 | — | 20 | — | A | 100 |
| Comp. Ex. 22 | A | 80 | 1 | 1 | 5 | 1 | A | 20 |
| Comp. Ex. 23 | A | 40 | 35 | 15 | 20 | 20 | A | 150 |
| Comp. Ex. 24 | A | 40 | 35 | — | 20 | — | A | 100 |
| Comp. Ex. 25 | A | 40 | 35 | — | 20 | — | A | 100 |
| Comp. Ex. 26 | A | 40 | 35 | — | 20 | — | A | 100 |
| Comp. Ex. 27 | A | 40 | 35 | — | 20 | — | A | 100 |
| Comp. Ex. 28 | A | 40 | 35 | — | 20 | — | A | 100 |
| Comp. Ex. 29 | A | 40 | 35 | — | 20 | — | A | 100 |
| Comp. Ex. 30 | A | 40 | 35 | — | 5 | — | A | 20 |
| Comp. Ex. 31 | A | 40 | 35 | — | 20 | — | A | 100 |
| Comp. Ex. 32 | A | 40 | 35 | — | 20 | — | B | 100 |
| Comp. Ex. 33 | A | 40 | 35 | — | 20 | — | B | 100 |
| Comp. Ex. 34 | A | 40 | 35 | — | 50 | — | B | 200 |
| Comp. Ex. 35 | A | 40 | 35 | — | 20 | — | B | 100 |
| Comp. Ex. 36 | A | 40 | 35 | — | 20 | — | B | 100 |
| Comp. Ex. 37 | A | 40 | 35 | — | 20 | — | B | 100 |
| Comp. Ex. 38 | A | 40 | 35 | — | 20 | — | B | 100 |
| Comp. Ex. 39 | A | 40 | 35 | — | 20 | — | B | 100 |
| Comp. Ex. 40 | A | 40 | 35 | — | 20 | — | B | 100 |
| Comp. Ex. 41 | A | 40 | 35 | — | 20 | — | B | 100 |
| Comp. Ex. 42 | A | 40 | 35 | — | 20 | — | B | 100 |
| Comp. Ex. 43 | A | 40 | 35 | — | 20 | — | B | 100 |

TABLE 4

| | Plating layer (1st layer) | | | | | | Chromate layer (2nd layer) | | Organic solvent type coating (3rd layer) | | | | | | | | |
|---|---|---|---|---|---|---|---|---|---|---|---|---|---|---|---|---|---|
| | Composition of plating excluding Zn (wt %) | | | | Plating amount | Particle size of $SiO_2$ in plating | Content of water-soluble matter | Plating amount of Cr | Main resin | | $SiO_2$ | | Thickness | | | Press[6] workability | Spot[7] weldability |
| | $SiO_2$ | Ni | Fe | Cr | ($g/m^2$) | (mμ) | (%)[1] | ($mg/m^2$) | Kind[2] | Amount (wt %) | Particle[3] size | Amount (wt %) | (μm) | Corrosion[4] resistance | Dissolving-[5] out of Cr | | |
| Example 30 | 0.1 | 15 | 0.01 | 0.1 | 20 | 5 | 0.5 | 45 | A | 50 | RM | 30 | 1 | | | | |
| Example 31 | 1 | 1 | 1 | 10 | 20 | 10 | 0.5 | 45 | A | 50 | RM | 30 | 1 | | | | |
| Example 32 | 3 | 5 | 2 | 1 | 20 | 20 | 0.5 | 45 | A | 50 | RM | 30 | 1 | | | | |
| Example 33 | 5 | 10 | 3 | 3 | 20 | 30 | 0.5 | 45 | A | 50 | RM | 30 | 1 | | | | |
| Example 34 | 10 | 5 | 1 | 5 | 20 | 50 | 0.5 | 45 | B | 50 | RM | 30 | 1 | | | | |
| Example 35 | 3 | 10 | 0.1 | 3 | 5 | 20 | 0.5 | 45 | A | 50 | RM | 30 | 1 | | | | |
| Example 36 | 3 | 10 | 0.1 | 3 | 20 | 30 | 3 | 45 | A | 50 | MM | 30 | 1 | | | | |
| Example 37 | 3 | 10 | 2 | 1 | 20 | 10 | 5 | 45 | A | 50 | MM | 30 | 1 | | | | |
| Example 38 | 3 | 10 | 0.1 | 3 | 20 | 20 | 0.5 | 10 | A | 50 | LM | 30 | 1 | | | | |
| Example 39 | 3 | 10 | 2 | 1 | 20 | 30 | 0.5 | 20 | A | 50 | LM | 30 | 1 | | | | |
| Example 40 | 3 | 10 | 0.1 | 3 | 20 | 40 | 0.5 | 100 | A | 50 | LM | 30 | 1 | | | | |
| Example 41 | 3 | 10 | 2 | 1 | 20 | 40 | 0.5 | 150 | B | 50 | LM | 30 | 1 | | | | |
| Example 42 | 3 | 10 | 0.1 | 3 | 20 | 30 | 0.5 | 45 | A | 50 | RM | 10 | 1 | | | | |
| Example 43 | 3 | 10 | 2 | 1 | 20 | 20 | 0.5 | 45 | A | 50 | RM | 15 | 1 | | | | |
| Example 44 | 3 | 10 | 0.1 | 3 | 20 | 30 | 0.5 | 45 | A | 50 | RM | 35 | 1 | | | | |
| Example 45 | 3 | 10 | 2 | 1 | 20 | 10 | 0.5 | 45 | A | 50 | RM | 40 | 1 | | | | |
| Example 46 | 3 | 10 | 0.1 | 3 | 20 | 20 | 0.5 | 45 | A | 50 | MM | 40 | 0.3 | | | | |
| Example 47 | 3 | 10 | 2 | 1 | 20 | 10 | 0.5 | 45 | B | 50 | MM | 40 | 2 | | | | |
| Example 48 | 3 | 10 | 0.1 | 3 | 20 | 20 | 0.5 | 45 | B | 50 | MM | 40 | 3 | | | | |
| Comp. Ex. 13 | — | 10 | — | — | 20 | — | 0.5 | 45 | A | 90 | — | — | 1 | X | | Δ | Δ |
| Comp. Ex. 14 | — | 10 | — | — | 20 | — | 0.5 | 45 | A | 50 | RM | 40 | 1 | Δ | | Δ | Δ |
| Comp. Ex. 15 | 3 | 10 | — | — | 20 | 200 | 0.5 | 45 | A | 90 | — | — | 1 | Δ | | Δ | Δ |
| Comp. Ex. 16 | 3 | 10 | 0.1 | 3 | 20 | 20 | 0.5 | 45 | C | 50 | RM | 40 | 1 | X | | Δ | Δ |
| Comp. Ex. 17 | 3 | 10 | 2 | 1 | 20 | 30 | 0.5 | 45 | D | 50 | RM | 40 | 1 | X | | Δ | Δ |
| Comp. Ex. 18 | 0.05 | 10 | — | — | 20 | 50 | 0.5 | 45 | A | 50 | RM | 40 | 1 | Δ | | | |
| Comp. Ex. 19 | 15 | 10 | — | — | 20 | 1000 | 0.5 | 45 | A | 50 | RM | 40 | 1 | | | X | Δ |
| Comp. Ex. 20 | 3 | 0.5 | — | — | 20 | 50 | 0.5 | 45 | A | 50 | RM | 40 | 1 | Δ | | | |
| Comp. Ex. 21 | 3 | 20 | — | — | 20 | 200 | 0.5 | 45 | A | 50 | RM | 40 | 1 | Δ | | | |
| Comp. Ex. 22 | 0.1 | 0.1 | 0.1 | 0.1 | 20 | 10 | 0.5 | 45 | A | 50 | RM | 40 | 1 | Δ | | | |
| Comp. Ex. 23 | 3 | 10 | 5 | 3 | 20 | 20 | 0.5 | 45 | A | 50 | RM | 40 | 1 | Δ | | | |
| Comp. Ex. 24 | 3 | 10 | — | — | 3 | 200 | 0.5 | 45 | A | 50 | RM | 40 | 1 | X | | Δ | Δ |
| Comp. Ex. 25 | 3 | 10 | — | — | 20 | 200 | 10 | 45 | A | 50 | RM | 40 | 1 | Δ | X | Δ | Δ |
| Comp. Ex. 26 | 3 | 10 | — | — | 20 | 200 | 0.5 | 5 | A | 50 | RM | 40 | 1 | Δ | | Δ | |
| Comp. Ex. 27 | 3 | 10 | — | — | 20 | 200 | 0.5 | 200 | A | 50 | RM | 40 | 1 | | | X | X |
| Comp. Ex. 28 | 3 | 10 | — | — | 20 | 200 | 0.5 | 45 | B | 50 | RM | 5 | 1 | Δ | | X | X |
| Comp. Ex. 29 | 3 | 10 | — | — | 20 | 200 | 0.5 | 45 | A | 50 | RM | 90 | 1 | | | X | X |
| Comp. Ex. 30 | 0.1 | 10 | — | — | 20 | 50 | 0.5 | 45 | A | 50 | RM | 40 | 0.1 | X | | X | Δ |
| Comp. Ex. 31 | 3 | 10 | — | — | 20 | 200 | 0.5 | 45 | A | 50 | RM | 40 | 4 | | | Δ | X |
| Comp. Ex. 32 | 3 | 10 | — | — | 20 | 200 | 0.5 | 45 | A | 50 | SS | 30 | 1 | | | X | Δ |
| Comp. Ex. 33 | 3 | 10 | — | — | 20 | 200 | 0.5 | 45 | A | 50 | SM | 30 | 1 | | | Δ | Δ |
| Comp. Ex. 34 | 10 | 10 | — | — | 20 | 500 | 0.5 | 45 | A | 50 | SL | 30 | 1 | Δ | | Δ | X |
| Comp. Ex. 35 | 3 | 10 | — | — | 20 | 200 | 0.5 | 45 | A | 50 | MS | 30 | 1 | | | X | Δ |
| Comp. Ex. 36 | 3 | 10 | — | — | 20 | 200 | 0.5 | 45 | A | 50 | RS | 30 | 1 | | | X | Δ |
| Comp. Ex. 37 | 3 | 10 | — | — | 20 | 200 | 0.5 | 45 | A | 50 | MS | 30 | 1 | | | X | Δ |
| Comp. Ex. 38 | 3 | 10 | — | — | 20 | 200 | 0.5 | 45 | A | 50 | ML | 30 | 1 | Δ | | Δ | X |

TABLE 4-continued

| | Plating layer (1st layer) | | | | | | Chromate layer (2nd layer) | | Organic solvent type coating (3rd layer) | | | | | | | | |
|---|---|---|---|---|---|---|---|---|---|---|---|---|---|---|---|---|---|
| | Composition of plating excluding Zn (wt %) | | | | Plating amount | Particle size of $SiO_2$ in plating | Content of water-soluble matter | Plating amount of Cr | Main resin | | $SiO_2$ | | Thick-ness | Corrosion[4] resistance | Dissolving-[5] out of Cr | Press[6] work-ability | Spot[7] weld-ability |
| | $SiO_2$ | Ni | Fe | Cr | ($g/m^2$) | (mμ) | (%)[1] | ($mg/m^2$) | Kind[2] | Amount (wt %) | Particle[3] size | Amount (wt %) | (μm) | | | | |
| Comp. Ex. 39 | 3 | 10 | — | — | 20 | 200 | 0.5 | 45 | A | 50 | RL | 30 | 1 | Δ | | Δ | X |
| Comp. Ex. 40 | 3 | 10 | — | — | 20 | 200 | 0.5 | 45 | A | 50 | ML | 30 | 1 | Δ | | Δ | X |
| Comp. Ex. 41 | 3 | 10 | — | — | 20 | 200 | 0.5 | 45 | A | 50 | LS | 30 | 1 | | | X | Δ |
| Comp. Ex. 42 | 3 | 10 | — | — | 20 | 200 | 0.5 | 45 | A | 50 | LM | 30 | 1 | | | Δ | Δ |
| Comp. Ex. 43 | 3 | 10 | — | — | 20 | 200 | 0.5 | 45 | A | 50 | LL | 30 | 1 | Δ | | Δ | X |

As is clear from Table 4, results of Examples 30–48 of the present invention are especially superior in corrosion resistance as well as resistance to dissolving-out of chromium, press workability and spot weldability to those of Comparative Examples13–15 where $SiO_2$ was not contained in both or eithcr of the plating layer and the film, Comparative Examples 16 and 17 where epoxy resin was not used as main resin of coating film and Comparative Examples 18–43 where the components are outside the ranges of the present invention.

What is claimed is:

1. A Zn—Ni based composite plated steel sheet excellent in corrosion resistance and workability which comprises a ferrous substrate and, provided thereon, a Zn—Ni based composite electroplated layer comprising 1–15% by weight of Ni, 0.1–10% by weight of Cr 0.1–10% by weight of $SiO_2$, having a particle size of 1 to smaller than 100 mμ 0.01–3% by weight of Fe and the balance of said layer being essentially Zn.

2. A Zn—Ni based composite plated steel sheet according to claim 1 which additionally comprises a Zn or Zn based alloy electroplated layer provided as upper layer on the composite electroplated layer.

3. A Zn—Ni based composite plated steel sheet according to claim 2 wherein amount of the upper Zn or Zn based alloy electroplated layer is 1–5 g/m$^2$.

4. A Zn—Ni based composite plated steel sheet according to claim 1 which additionally comprises a hardly soluble chromate film layer of 10–150 mg/m$^2$ in total Cr content provided on the composite electroplated layer and an epoxy resin thin film layer containing agglomerated $SiO_2$ provided on said chromate film layer.

5. A Zn—Ni based composite plated steel sheet according to claim 4 wherein the chromate film layer has a content of water-soluble matter of 5% or less

6. A Zn—Ni based composite plated steel sheet to claim 2 which additionally comprises a hardly soluble chromate film layer of 10–150 mg/m$^2$ in total Cr content provided on the Zn or Zn based alloy electroplated layer and an epoxy resin film layer containing agglomerated $SiO_2$ provided on said chromate film layer

7. A Zn—Ni based composite plated steel sheet according to claim 4 wherein content of the agglomerated $SiO_2$ in the epoxy resin film layer is 20–80% by weight of the epoxy resin.

8. A Zn—Ni based composite plated steel sheet according to claim 4 wherein the $SiO_2$ is a secondary agglomerate having a particle size of 0.3–3 μ which is formed by agglomeration in the epoxy resin.

9. A Zn—Ni based composite plated steel sheet according to claim 4 wherein the epoxy resin film layer has a thickness of 0.3–3.

10. A Zn—Ni based composite plated steel sheet according to claim 1 wherein the ferrous substrate is a dull finished steel sheet, a bright finished steel sheet, a high-tensile steel sheet or low corrosion rate steel sheet.

11. A method for makinq a Zn—Ni based composite plated steel sheet which comprises subjecting a ferrous substrate to electrolysis in an acidic Zn—Ni electroplating bath containing 5–50 g/l of $SiO_2$ and $Fe^{2+}$ and $Cr^{3+}$which are adsorbed to $SiO_2$ to positively charge the $SiO_2$

12. A method for making a Zn—Ni based composite plated steel sheet which comprises subjecting a ferrous substrate to electrolysis in an acidic Zn—Ni based composite electroplating solution containing 5–50 g/l of $SiO_2$ and $Fe^{2+}$ and $Cr^{3+}$ which are adsorbed to $SiO_2$ to positively charge the $SiO_2$, then to formation of a hardly soluble chromate film and finally to coating of agglomerated $SiO_2$-containing solvent type epoxy resin thin film.

13. A method according to claim 11 wherein the Zn—Ni based composite electroplating solution containing +-60 g/l of $Zn^{2+}$, 5–60 g/l of $Ni^{2+}$1–30 g/l of $Cr^{3+}$, 5–50 g/l of $SiO_2$ and 0.1–10 g/l of $Fe^{2+}$.

14. A method according to claim 11 wherein the electrolysis is carried out at a current density of 50–300 A/dm$^2$.

15. The Zn–Ni based composite plated steel sheet of claim 1 wherein said electroplated layer is plated in an amount of 10–15 g/m$^2$.

* * * * *